US005743392A

United States Patent [19]

Chapman

[11] Patent Number: 5,743,392

[45] Date of Patent: Apr. 28, 1998

[54] HOLDER FOR JIG SAW PUZZLES, DRAWINGS, PHOTOS AND THE LIKE

[76] Inventor: David R. Chapman, 145 Wychwood Place, London, Ontario, Canada, N6G 1S7

[21] Appl. No.: 563,599

[22] Filed: Nov. 28, 1995

[51] Int. Cl.[6] ..... B65D 85/20

[52] U.S. Cl. ..... 206/315.1; 206/579; 383/10; 383/24

[58] Field of Search ..... 206/315.1, 579; 383/7, 9, 10, 22, 24, 27

[56] References Cited

U.S. PATENT DOCUMENTS

| | | | |
|---|---|---|---|
| 2,586,017 | 2/1952 | Freedman . | |
| 3,504,915 | 4/1970 | Walker . | |
| 3,567,110 | 3/1971 | Susuki et al. | 383/10 |
| 3,677,399 | 7/1972 | Tatar . | |
| 3,941,245 | 3/1976 | Oliverius | 383/7 |
| 4,125,220 | 11/1978 | Suominen | 383/9 |
| 4,140,317 | 2/1979 | Ramney . | |
| 4,302,013 | 11/1981 | Kavis | 206/315.1 |
| 4,436,307 | 3/1984 | Caldwell . | |
| 4,479,651 | 10/1984 | LaFleur . | |
| 4,484,745 | 11/1984 | Sleeper . | |
| 4,486,018 | 12/1984 | Keller, Jr. . | |
| 4,552,361 | 11/1985 | LaFleur . | |
| 4,579,224 | 4/1986 | Heavener | 206/579 |
| 4,591,051 | 5/1986 | Lowman | 206/579 |
| 4,865,325 | 9/1989 | Stolz . | |
| 4,984,798 | 1/1991 | Silberstein | 206/315.1 |

FOREIGN PATENT DOCUMENTS 2216022 10/1989 United Kingdom .

*Primary Examiner*—Paul T. Sewell
*Assistant Examiner*—Nhan T. Lam
*Attorney, Agent, or Firm*—Stanley E. Johnson

[57] ABSTRACT

A holder for jigsaw puzzles, game pieces, pictures or the like that includes a stiff rectangular panel having an upper flat surface on which the pieces can be assembled, a flexible cover sheet that removably overlies the pieces on such upper flat surface of said member and a pouch for the panel. Each of the pouch and panel have a carrying handle and these are aligned with one another when the panel is fully inserted into the pouch. The handles are an integral part of the respective members associated therewith. The panel's side edges taper inwardly toward one another in a direction toward the bottom edge thereof and the pouch side edges have a corresponding taper. The upper surface of the panel has a matt non-slip surface as does also the flexible cover sheet.

10 Claims, 3 Drawing Sheets

HOLDER FOR JIG SAW PUZZLES, DRAWINGS, PHOTOS AND THE LIKE

FIELD OF INVENTION

This invention relates to a holder for use in the storage and/or transport of multi piece articles such as game board pieces (e.g. Scrabble), jig saw puzzles, or flimsy sheet type articles such as artwork, engineering and the like drawings, photos and paperwork for presentation purposes. For purposes of illustration and presentation of the invention reference hereinafter will be to a holder and described with reference to use as a jig saw puzzle holder.

BACKGROUND OF INVENTION

Devices facilitating assembly, storage, and transportation of jigsaw puzzles are known and by way of example reference may be had to U.S. Pat. No. 4,436,307 issued Mar. 13, 1984 naming T. Francis Caldwell as inventor and International application PCT/GB89/00158 published Sep. 8, 1989 under international publication number WO89/07969 naming David Shillito and Denis Parkinson as co-inventors.

U.S. Pat. No. 4,436,307 discloses a tray for holding assembled puzzle pieces and two storage trays for holding unassembled pieces. For transport purposes the small trays fit into the larger tray and these fit into a fold over flap enclosure.

The aforementioned PCT application discloses a support on which pieces can be assembled and includes two stiff covers that are pivoted or hingedly attached to the support member to fold over and overly the assembled pieces. The device is simple but the bottom edge is open and thus the puzzle, or pieces therefor, can escape when transported particularly in a vertical orientation.

SUMMARY OF INVENTION

An object of the present invention is to provide a multi-purpose device described herein for use for example in the assembly, transport and/or storage of jigsaw puzzles and pieces therefor. The device has the parts thereof so arranged as to ensure the assembled pieces and/or individual pieces therefor are held captive during transport and storage.

More particularly there is provided in accordance with the present invention a multi-purpose device for use, for example in assembling, transporting and/or storing a jigsaw puzzle comprising a rectangular stiff member having a flat upper surface on which the puzzle can be assembled, an overlay piece of flexible film selectively positionable to cover pieces on said flat upper surface, a handle on said stiff member and a pouch for removably receiving therein said stiff member with said flexible film overlying said flat upper surface, said pouch having a handle and wherein said handles are disposed in alignment with one another when said stiff member is located in said pouch.

LIST OF DRAWINGS

The invention is illustrated by way of example in the accompanying drawings wherein.

DESCRIPTION OF PREFERRED EMBODIMENT

Figure 1:
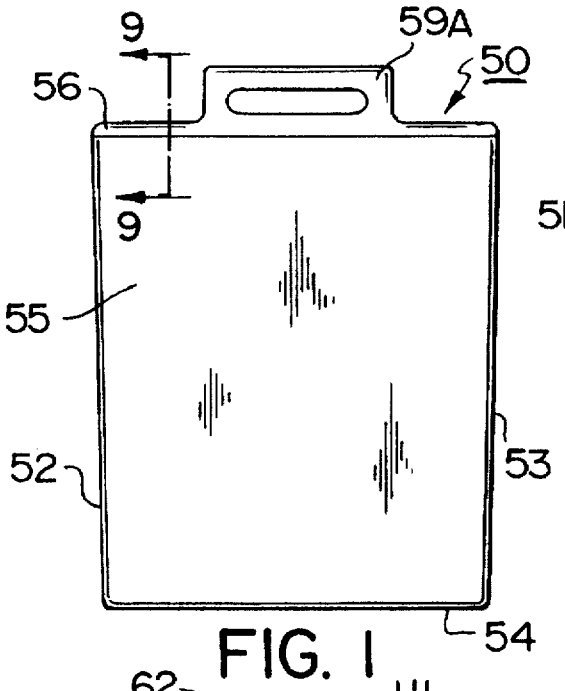
FIG. 1 is a front view of the pouch portion only of a holder of the present invention comprised of a pouch and removable insert.
Figure 2:
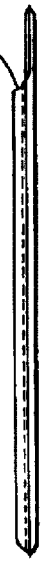
FIG. 2 is a side view of FIG. 1.

The device of the present invention comprises a stiff panel and a pouch therefor with each being provided with a handle. Referring to the drawings there is illustrated a stiff panel 10 on which pieces are placed, e.g. puzzle pieces, and a pouch 50 for receiving therein the panel 10. Each of the panel 10 and pouch 50 has a carry handle and these handles are aligned when the panel is in the pouch. To facilitate insertion and removal of the panel and accomplish a mating interfit relation the side edges of the panel and corresponding edges of the pouch are tapered.

The panel 10 (see FIGS. 3, 7, 8 and 10) has an upper work surface 11 on which the puzzle pieces can be assembled and a flexible sheet 12 that overlies the pieces on the work surface. The work surface 11 preferably has a non-slip surface finish. The film piece 12 is a flexible sheet of material, for example vinyl film, and it is shown in the preferred form as being attached to the bottom edge of the panel as indicated at 13. Attaching along this edge ensures the puzzle or puzzle pieces will not escape when carried in a vertical position. The cover sheet 12, however, if desired instead of being attached can be a separate element.

The panel 10 has opposed marginal edges 14 and 15 and a bottom edge 16. The pouch 50 has corresponding marginal side edges 52 and 53 and a bottom edge 54.

Figure 3:
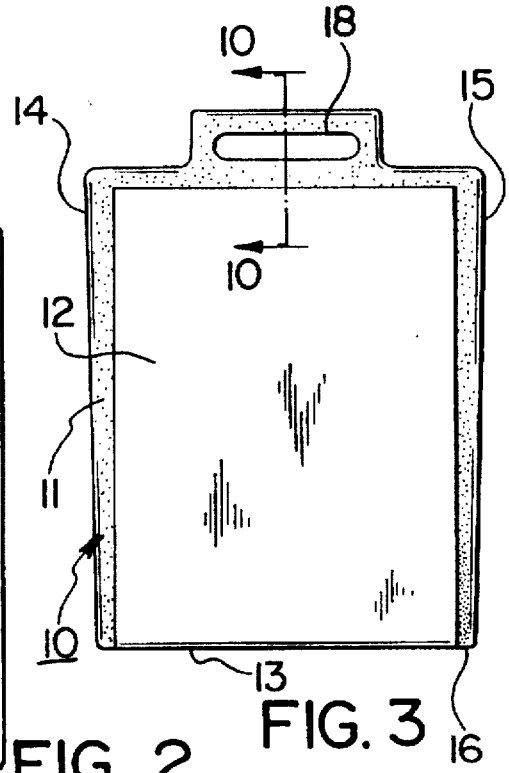
FIG. 3 is a front view of a stiff panel, which constitutes the other portion of the holder, that is insertable into the pouch shown in FIG. 1.

The panel 10 co-operates with pouch 50 in their tapered interfit relationship and by the fact they have handles that align for carrying the unit. Firstly the panel edges 14 and 15 taper inwardly in a direction toward the bottom end edge 16 and the pouch's corresponding edges 52 and 53 are of the same taper. The dimensions of the panel and the pouch are such that the side edges of the panel are in close proximity to the interior side edges of the pouch and the bottom edge 16 of the panel in close proximity with the interior bottom end 54 of the pouch when the panel and pouch are in the assembled state. There should be little or no relative movement of the stiff panel and pouch to ensure the pieces on the panel don't move about. The taper fit provides a close inter-fit relation and facilitates insertion and removal of the panel. There can be a "locking in" effect in the last 1 to 2 cm. or so of travel of the panel into the pouch depending upon the amount of taper. By way of example an actual panel as shown in FIG. 3 measured 43 cm. along the bottom edge 13 and 45 cm. along the upper edge with the distance between such edges being 55½ cm. The handle extends 7½ cm. above the upper edge and has a 12 cm. inset from the respective side edges. An actual pouch measured 44 cm. along the bottom edge 54 and 46½ cm. along the upper edge and 56 cm. between such edges.

The stiff panel 10 and pouch 50 further cooperate with one another by each having a handle and these handles are in close alignment with one another when the panel 10 is in its "lock-in" position in the pouch. While not necessary it is desirable to have the dimensioning such that the bottom end of the panel 10 doesn't engage the bottom end of the pouch. This will obviously extend the life of the seam (or fold) that provides the bottom end 54 of the pouch.

The upper surface 11 of the stiff panel has a non skid surface provided for example by a flock applied to a base film material. The flexible film piece 12 has a corresponding flock surface 12A which bears against the puzzle pieces when it is in the position shown in FIG. 3.

As previously mentioned each of the pouch and stiff panel has a handle and these handles are in alignment with one another for use in carrying the assembled unit. Referring to FIG. 3, panel 10 has an elongate aperture 18 that provides a finger grip handle. While an elongate slot 18 is preferred there could be a series of holes for respective ones of individual or multiple fingers.

Figure 4:
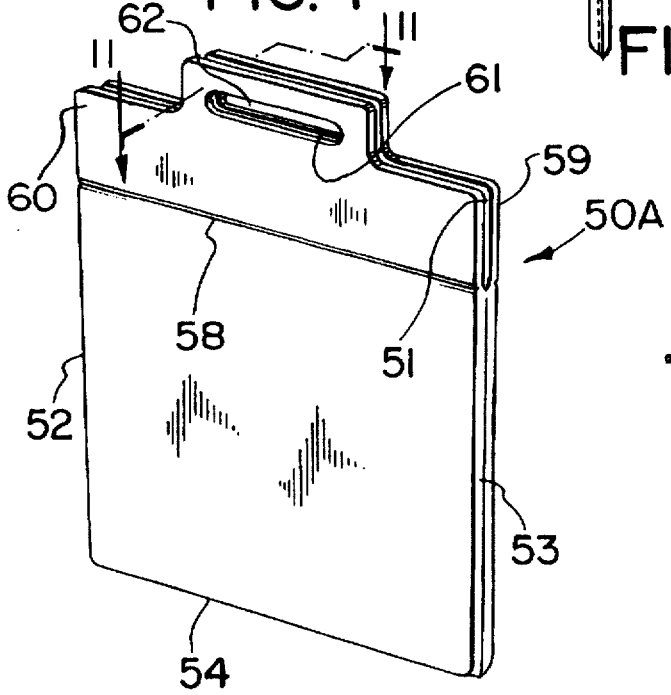
FIG. 4 is an oblique view of a pouch provided with two handles.
Figure 5:
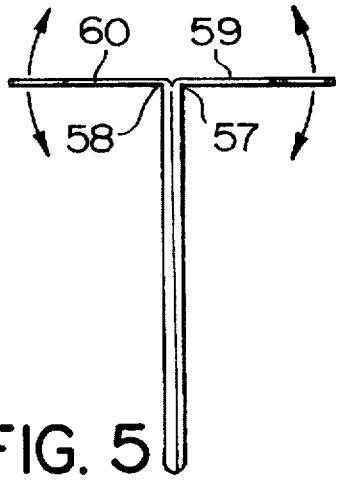
FIG. 5 is a side view of FIG. 4 illustrating moveability of the handles.
Figure 6:
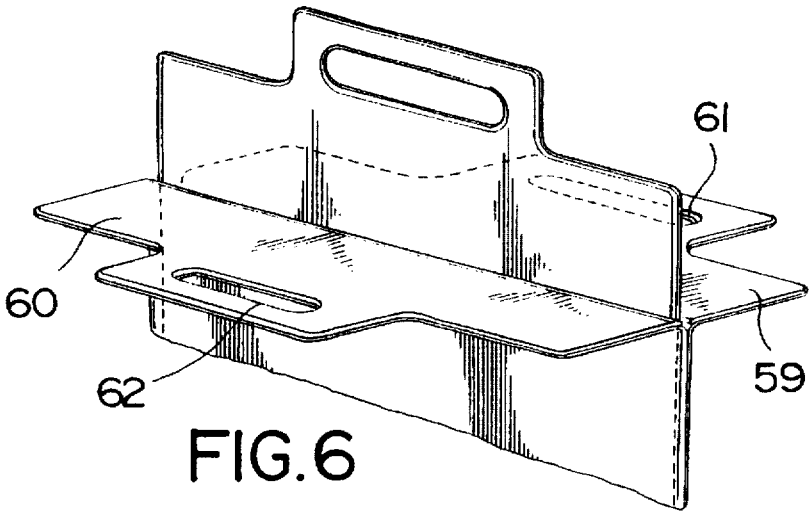
FIG. 6 is an oblique view of an upper portion of the pouch of FIG. 5 with the stiff panel of FIG. 3 inserted therein.

The pouch 50 is formed from a pair of walls 55 and 56 seamed together along the side edges 52 and 53 and along the bottom 54. The pair of walls are not joined along the top edge and this provides an opening into the pocket of the pouch. Two different embodiments of the pouch are illustrated. In one embodiment in which the pouch is designated 50 there is only one handle (see FIGS. 1 and 12) and in the other embodiment in which the pouch is designated 50A there are two handles (see FIGS. 4 and 5). In the two handle embodiment the walls 55 and 56 have respective hinge lines 57 and 58 extending generally parallel to the open end. A portion of the walls above these hinge lines provide handles 59 and 60 which have respective finger grip slots 61 and 62. FIG. 5 illustrates movement of the handles 59 and 60 and in FIG. 6 they are shown moved away from the stiff panel 10. This provides for ease of insertion of the panel 10 into the pouch 50A and also grasping the handle of the panel 10 only for removing the panel from the pouch.

In the single handle embodiment wall 56 extends beyond the upper end of wall 55 and this extending portion provides the single handle designated 59A. This handle 59A is rigid relatively to the remainder of the wall 56, i.e. there is no hinge line 57 as previously described with reference to handle 59.

Figure 10:
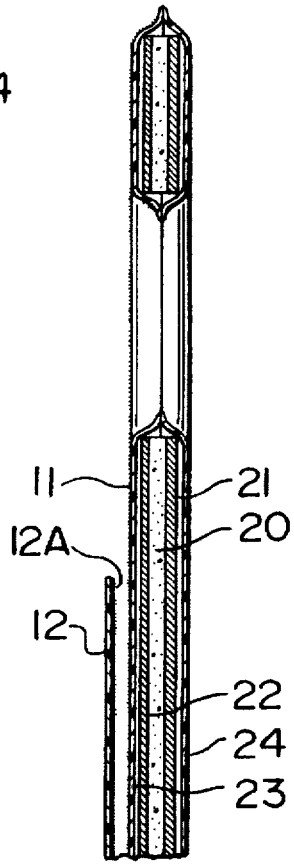
FIG. 10 is an enlarged partial sectional view along line 10—10 of FIG. 3.
Figure 9:
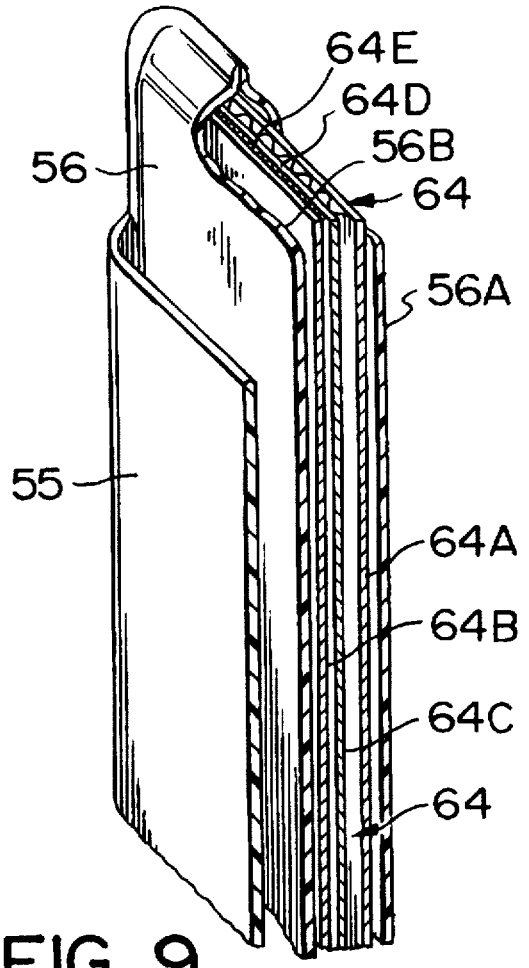
FIG. 9 is a broken away sectional view taken essentially along line 9—9 of FIG. 1.
Figure 11:
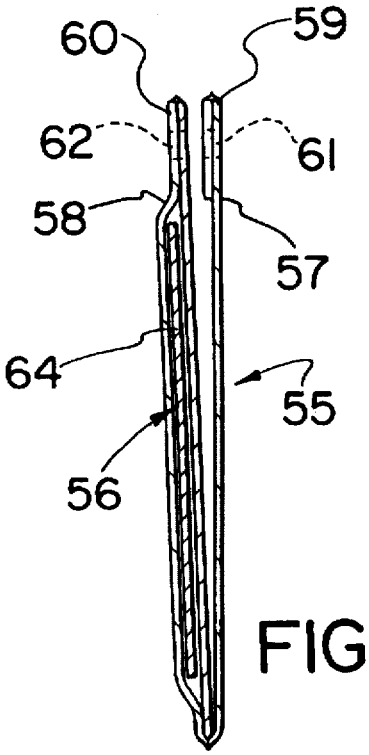
FIG. 11 is a sectional elevational view taken essentially along line 11—11 of FIG. 4.

FIGS. 9, 10 and 11 are cross-sectional views with FIG. 10 being a section through a portion of the stiff panel 10. FIG. 9 is a broken away sectional view of a portion of the single handle pouch 50 of FIG. 1 and FIG. 11 is a sectional view through the two handle pouch 50A of FIG. 4.

The pouch (50 and 50A) is preferably made of a heat sealable vinyl material heat sealed along edges 52, 53 and 54. This forms the pouch from the respective walls 55 and 56. As seen from FIGS. 9 and 11 wall 55 is preferably a single sheet thickness of vinyl material with a double thickness providing the handle portion 59 in the two handle embodiment. The ending of the double thickness effectively provides a predefined hinge line 57 between the handle and the wall. Wall 56 on the other hand is a double layer (56A, 56B) of vinyl material seamed along the outer periphery by heat sealing and holding captive therein a stiffener panel 64. The stiffener panel 64, in the two handled embodiment, has an upper edge in the vicinity of the hinge line 58 and this hinge line, if desired, may be a heat seal seam joining the two layers together. In the single handle embodiment the stiffener panel 64 extends continuously up through the handle portion 59A.

The stiffener panel 64 may be a single cardboard layer as shown in FIG. 11 or be multi-layered shown by way of example in FIG. 9. Referring to FIG. 9 the stiffener 64 has respective outer thin cardboard layers 64A and 64B and a central layer 64C. The layers 64A and 64C are separated by a corrugated layer 64D and layers 64B and 64C are separated by a corrugated layer 64E. The corrugations in layer 64D are deeper than in layer 64E and the corrugations in these layers are transverse to one another.

The stiff panel board 10 is shown in partial cross-section in FIG. 10 and in the preferred form is of sandwich construction having a resiliently compressible inner layer. Referring to FIG. 10 there is illustrated a resiliently compressible layer 20 of foam material sandwiched between respective stiff cardboard layers 21 and 22. Layer 22, adjacent the flocked work surface 11, is thinner than layer 21. This compressible sandwich is held captive in a pocket provided by top and bottom vinyl sheets 23 and 24. The vinyl sheets 23 and 24 are heat sealed together about their outer periphery along marginal edges 14, 15, 16 and along the top edge around the handle and around the handle opening. In the preferred construction the inner layer 20 is held in a state of compression by the outer vinyl sheets.

The top vinyl sheet 23 is provided with a flock material on the area that defines the upper work surface 11 for assembling the puzzle pieces thereon. This work surface is stabilized by the backing member and the material is taut due to core 20 being held under a state of compression by the vinyl sheets.

As seen from FIG. 10 the flexible film 12 is a single sheet of a plastics material for example vinyl with a flock inner surface 12A.

Figure 7:
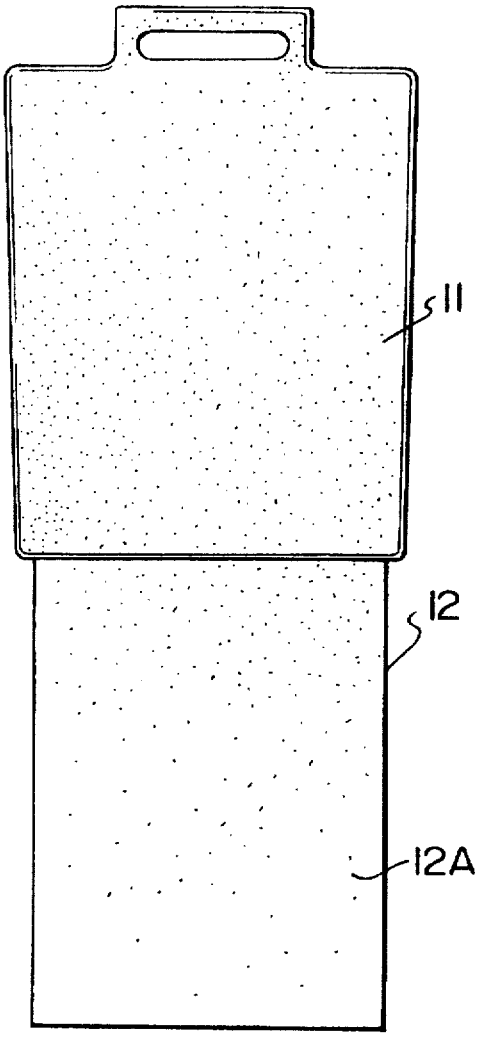
FIG. 7 shows the stiff panel of FIG. 3 in an open position exposing the face on which the puzzle pieces are assembled.
Figure 8:
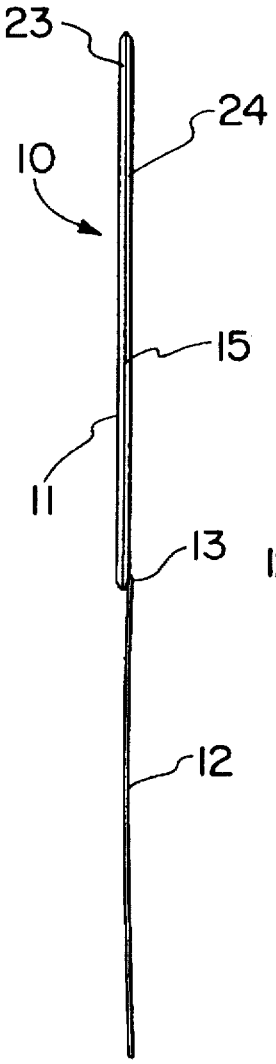
FIG. 8 is a side view of FIG. 7.

FIG. 8 is an edge view of the panel shown in FIG. 7, panel 10 being a rigid panel member of sandwich construction as shown in FIG. 10 and having a flock upper work surface 11 on which pieces can be assembled. The flexible sheet 12 is shown extending away from the stiff panel but, if desired, it could readily be folded under the rigid panel while puzzle pieces are being assembled on the flock surface 11 or as previously mentioned it could be a film piece separate from the rigid panel.

Figure 12:
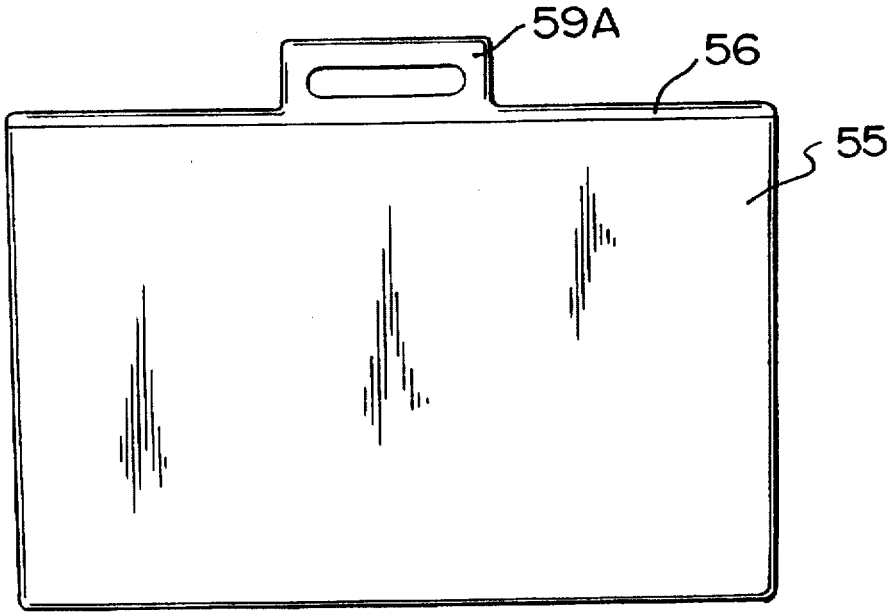
FIG. 12 is a front view of a pouch of different dimension from that shown in FIG. 1.

FIG. 12 illustrates a pouch which is substantially wider than the pouch in FIG. 1 and a stiff panel of corresponding size can be provided which is of the same construction as shown in FIG. 10.

I claim:

1. A holder for multi-piece items such as jigsaw puzzles comprising:

(a) a stiff rectangular planar member having a top edge, a bottom edge, a pair of side edges and an upper flat surface on which the pieces can be assembled;

(b) a flexible cover sheet to overlie pieces on said upper flat surface of said member;

(c) a carrying handle on the top edge of said stiff member;

(d) a pouch which is open at a top end thereof and comprising front and rear walls joined together along a common bottom edge thereof and along a respective one of a pair of spaced apart side edges, said walls having top edges and;

(e) a carrying handle on said pouch at said open top end thereof, said handle on said pouch and said handle on said stiff member being aligned in overlapping relation with one another for use in carrying the holder when said stiff member is essentially fully inserted into said pouch and wherein said stiff member side edges taper inwardly toward one another in a direction toward the bottom edge thereof and wherein said pouch side edges have a corresponding taper.

2. A holder as defined in claim 1 wherein said stiff member and pouch side edges interfit in mating abutting relation when said carrying handles are essentially in alignment with one another.

3. A holder as defined in claim 1 wherein said handles are an integral part of the respective members associated therewith.

4. A holder as defined in claim 1 wherein each of said pouch walls has a handle thereon.

5. A holder as defined in claim 1 wherein said flexible cover sheet is affixed to said stiff rectangular member along the bottom edge thereof.

6. A holder as defined in claim 1 wherein said upper surface of said stiff member has a matt non-slip surface.

7. A holder for multi-piece items such as jigsaw puzzles comprising:

(a) a stiff rectangular planar member having a top edge, a bottom edge, a pair of side edges and an upper flat surface on which the pieces can be assembled;

(b) a flexible cover sheet to overlie pieces on said upper flat surface of said member;

(c) a carrying handle on the top edge of said stiff member;

(d) a pouch which is open at a top end thereof and comprising front and rear walls joined together along a common bottom edge thereof and along a respective one of a pair of spaced apart side edges, said walls having top edges and;

(e) a carrying handle on said pouch at said open top end thereof, said handle on said pouch and said handle on said stiff member being aligned in overlapping relation with one another for use in carrying the holder when said stiff member is essentially fully inserted into said pouch and wherein said stiff member comprises a vinyl casing including a core member and wherein said core member is of sandwich construction comprising a resiliently compressible member disposed between a pair of rigid members and wherein said casing maintains said core in a compressed state.

8. A holder for multi-piece items such as jigsaw puzzles comprising:

(a) a stiff rectangular planar member having a top edge, a bottom edge, a pair of side edges and an upper flat surface on which the pieces can be assembled;

(b) a flexible cover sheet to overlie pieces on said upper flat surface of said stiff rectangular member;

(c) a carrying handle securely located on said stiff member and disposed adjacent said top edge thereof;

(d) a pouch providing a pocket for receiving therein, in close fitting relation, said stiff rectangular member, said pouch being open at a top end thereof for removably inserting said stiff member into said pocket, said pouch comprising front and rear walls joined together along a common bottom edge thereof and along a respective one of a pair of spaced apart side edges, said walls having top edges; and (e) a carrying handle securely located on said pouch and disposed at said top end thereof, said handle on said pouch and said handle on stiff member being aligned in overlapping relation with one another for use in carrying the holder and stiff member when said stiff member is essentially fully inserted into said pouch, said stiff member including a core of sandwich construction enclosed in an envelope of plastics sheet material and wherein one of said front and rear walls of said pouch comprises a stiff wall.

9. A holder as defined in claim 8 wherein said stiff wall of said pouch is provided by a cardboard insert.

10. A device for use in assembling, transporting and storing a jigsaw puzzle comprising a rectangular stiff member having a flat upper surface on which the puzzle can be assembled, a flexible cover sheet attached to said stiff member along one edge of said stiff member, a handle on said stiff member at an edge thereof opposite said one edge; and a pouch for receiving therein, in close fitting relation, said stiff member; said pouch having a handle formed integral with one of the walls thereof and extending beyond an opening into said pouch for receiving said stiff member, wherein said stiff member handle and said pouch handle are in alignment in overlapping relation when said stiff member is located in said pouch and wherein each of said stiff member and pouch have corresponding tapered side marginal edges.

* * * * *